US010174574B2

(12) United States Patent
Mansukh et al.

(10) Patent No.: US 10,174,574 B2
(45) Date of Patent: Jan. 8, 2019

(54) INSERT FOR USE WITH WELLHEAD HOUSING HAVING FLOW-BY PATH

(71) Applicant: Vetco Gray Inc., Houston, TX (US)

(72) Inventors: Mayur Mansukh, Houston, TX (US); Aniruddha D. Gadre, Houston, TX (US); Daniel Caleb Benson, Houston, TX (US); David Lawrence Ford, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 177 days.

(21) Appl. No.: 14/524,767

(22) Filed: Oct. 27, 2014

(65) Prior Publication Data

US 2015/0267495 A1 Sep. 24, 2015

Related U.S. Application Data

(60) Provisional application No. 61/954,976, filed on Mar. 18, 2014.

(51) Int. Cl.

| | |
|---|---|
| ***E21B 33/04*** | (2006.01) |
| ***E21B 19/06*** | (2006.01) |
| ***E21B 19/10*** | (2006.01) |
| ***E21B 33/05*** | (2006.01) |

(52) U.S. Cl.

CPC ..... *E21B 33/0422* (2013.01); *E21B 19/06* (2013.01); *E21B 19/10* (2013.01); *E21B 33/04* (2013.01); *E21B 33/05* (2013.01)

(58) Field of Classification Search

CPC ..... E21B 33/04; E21B 33/0422; E21B 19/06; E21B 19/10; E21B 33/05

USPC ..... 166/785.14

See application file for complete search history.

(56) References Cited

U.S. PATENT DOCUMENTS

| | | | | |
|---|---|---|---|---|
| 5,456,314 | A | 10/1995 | Boehm, Jr. et al. | |
| 6,719,044 | B2 | 4/2004 | Ford et al. | |
| 6,945,325 | B2 | 9/2005 | Ford et al. | |
| 7,150,323 | B2 | 12/2006 | Ford | |
| 7,798,231 | B2 | 9/2010 | Ford | |
| 7,900,706 | B2 | 3/2011 | Ford | |
| 8,066,064 | B2 | 11/2011 | Minassian et al. | |
| 8,360,147 | B2 | 1/2013 | Ford et al. | |
| 2006/0231248 | A1 * | 10/2006 | Ford | E21B 33/043 166/89.1 |

(Continued)

FOREIGN PATENT DOCUMENTS

| | | | |
|---|---|---|---|
| GB | 2462520 | A | 2/2010 |
| WO | 2010080294 | A2 | 7/2010 |

OTHER PUBLICATIONS

International Search Report and Written Opinion issued in connection with corresponding PCT Application No. PCT/US2015/020506 dated Jun. 2, 2015.

*Primary Examiner* — Taras P Bemko
(74) *Attorney, Agent, or Firm* — Hogan Lovells US LLP

(57) ABSTRACT

A wellhead assembly having an insert that is disposed between a wellhead housing and casing hanger. Axial slots through the insert define a flow path between the wellhead housing and casing hanger. The insert is made from a higher strength material and supports a load exerted between the casing hanger and wellhead housing. The insert is a ring like member, and the slots can more easily be machined in the insert than in the wellhead housing.

17 Claims, 3 Drawing Sheets

(56) References Cited

U.S. PATENT DOCUMENTS

| | | | | |
|---|---|---|---|---|
| 2011/0226490 | A1* | 9/2011 | Nguyen | E21B 33/035 166/382 |
| 2011/0253389 | A1* | 10/2011 | Nguyen | E21B 33/04 166/382 |
| 2013/0068466 | A1* | 3/2013 | Ghumre | E21B 33/043 166/348 |

* cited by examiner

INSERT FOR USE WITH WELLHEAD HOUSING HAVING FLOW-BY PATH

CROSS REFERENCE TO RELATED APPLICATIONS

This application claims priority to and the benefit of, U.S. Patent Application Ser. No. 61/954,976, filed Mar. 18, 2014, the full disclosure of which is hereby incorporated by reference herein for all purposes.

BACKGROUND OF THE INVENTION

1. Field of Invention

The present disclosure relates in general to a wellhead assembly having an annular insert between a wellhead housing and lockdown ring, and that includes axially formed flow by paths.

2. Description of Prior Art

Wellheads used in the production of hydrocarbons extracted from subterranean formations typically include a wellhead assembly attached at the upper end of a wellbore formed into a hydrocarbon producing formation. Support hangers for suspending production tubing and casing into the wellbore are generally included within the wellhead assemblies. The casing lines the wellbore and isolates the wellbore from the surrounding formation. The tubing, which typically lies concentric within the casing, provides a conduit therein for producing the hydrocarbons entrained within the formation.

Wellhead assemblies also typically include a wellhead housing and a production tree atop the wellhead housing. Wellhead housings are often adjacent where the casing and tubing enter the wellbore. The production tree is commonly used to control and distribute the fluids produced from the wellbore and selectively provide fluid communication or access to the tubing, casing, and/or annuluses between the tubing and casing. Valves assemblies are typically provided within wellhead production trees for controlling fluid flow across a wellhead, such as production flow from the borehole or circulating fluid flow in and out of a wellhead.

Lockdown rings typically restrain each casing hanger within the wellhead housing to prevent relative axial movement between the casing hanger and wellhead housing. Usually proximate the lockdown rings are return passages that allow fluid flow during cementing operations. The passages typically are bored axially through the casing hangers and are in the form of slots along the inner surface of the wellhead housing.

SUMMARY OF THE INVENTION

Disclosed herein is an example of a wellhead assembly which includes an annular wellhead housing, a groove circumscribing an inner circumference of the wellhead housing, a casing hanger inserted into the wellhead housing set adjacent the groove, and an insert set in the groove having a slot that defines an axial flow path between the wellhead housing and the casing hanger. A channel can be included that circumscribes an inner surface of the insert and along with a lock ring for transferring an axial for between the casing hanger and the wellhead housings, wherein the lock ring has an upper portion that inserts into the channel. In this example the inner surface of the insert is generally parallel with an axis of the wellhead assembly above and below the channel. The wellhead assembly may optionally include a multiplicity of slots formed in the insert that define a series of block portions in the insert that are between adjacent slots. In an example, the insert has an upper surface that depends downward with distance from an axis of the wellhead assembly. The slot can intersect an outer radial surface of the insert. The wellhead assembly can further include a cement return passage in the casing hanger that is in communication with the slot. In an example, the insert is formed from a material having a strength that is greater than that of a material of the wellhead housing. A seal assembly can be included between the casing hanger and the wellhead housing above the insert.

Another example of a wellhead assembly is made up of a wellhead housing circumscribing an annular hanger, an insert extending circumferentially in an annulus between the wellhead housing and hanger, a lock ring between the insert and the hanger and which transfers an axial force between the casing hanger and insert, and slots in the insert that define a flow path axially through the insert. The hanger can be of a casing hanger or a tubing hanger. The slots can be in communication with an annular space above the insert and that is between the hanger and the wellhead assembly. Optionally, the slots are in communication with an annular space below the insert and that is between the hanger and the wellhead assembly. The wellhead assembly can include a seal assembly in an annular space between the hanger and the wellhead housing that is energized with an energizing ring.

A yet additional example of a wellhead assembly includes an annular wellhead housing, a groove circumscribing an inner circumference of the wellhead housing, a casing hanger inserted into the wellhead housing set adjacent the groove; an insert set in the groove having a slot that defines an axial flow path between the wellhead housing and the casing hanger, a lock ring coupled between the insert and the casing hanger and which forms a load path that extends between the casing hanger and wellhead housing, and through the lock ring and insert. In this example, the slot can extend axially through the insert and intersect a lower surface of the insert, a radial outward surface of the insert, and a radial forward surface of the insert. The wellhead assembly may further include a channel on an inner radial surface of the insert that engages an upper portion of the lock ring.

BRIEF DESCRIPTION OF DRAWINGS

Some of the features and benefits of the present invention having been stated, others will become apparent as the description proceeds when taken in conjunction with the accompanying drawings, in which.

Figure 2:
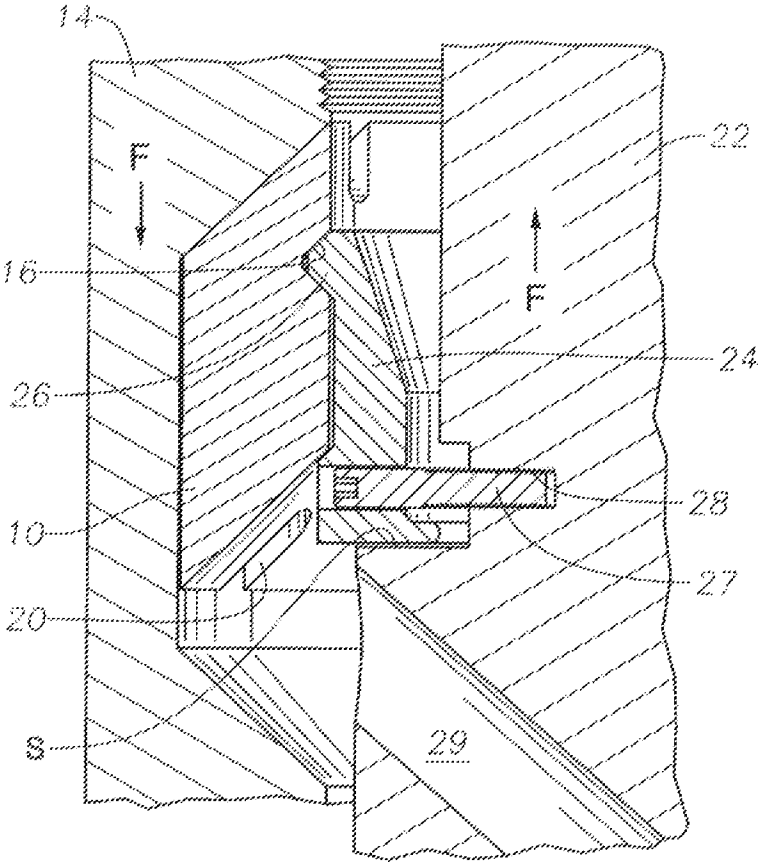
FIG. 2 is a partial sectional and perspective view of the insert of FIG. 1 and further including a lock ring and wellbore hanger.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
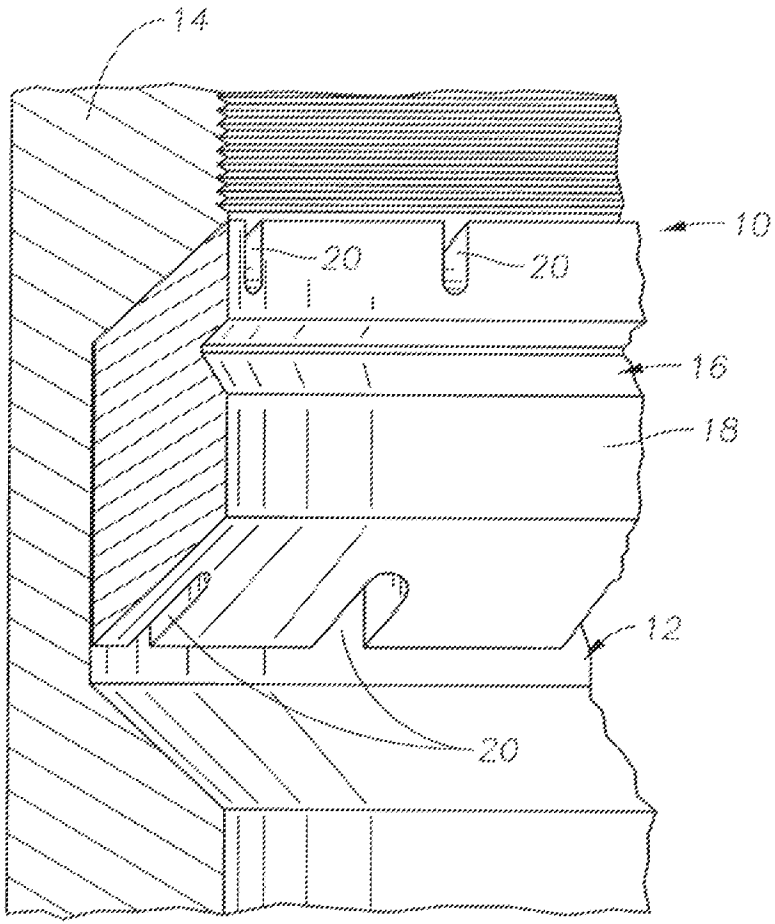
FIG. 1 is a partial sectional and perspective view of an example of an insert disposed in a wellhead housing.

Illustrated in a sectional perspective view in FIG. 1 is one example of an annular insert 10, which is shown placed in a groove 12 formed on an inner surface of a high pressure wellhead housing 14. A channel 16 is formed on a radially inward facing surface of insert 10 and extends along the entire circumference of the inner surface of insert 10. Formed in the body 18 of insert 10 of FIG. 1 are a series of slots 20 that project axially through insert 10. In the example, the slots 20 extend from a lower surface of insert 10 and exit a forward facing surface of insert 10 above channel 16. As will be illustrated in more detail below, in one example the slots 20 intersect both a radial outward facing surface of insert 10 and an upward facing surface of insert 10. In an example, the insert is formed from a material having a higher strength than a material used for forming the high pressure wellhead housing 14. Examples of measures of material strength include ultimate strength, yield strength, Young's modulus, Poisson's ratio, and combinations thereof.

FIG. 2 shows an inside sectional view of an example of a high pressure wellhead housing 14 circumscribing a wellbore hanger 22, wherein hanger 22 can be any type of hanger for use in a wellbore, such as a casing hanger or tubing hanger. An annular lock ring 24 provides a locking force for locking hanger 22 to wellhead housing 14. More specifically, lock ring 24 transfers an axial force F between casing hanger and wellhead housing 14 through lock ring 24 and through insert 10. Lock ring 24 has an upper portion 26 which projects radially outward and into channel 16 for transferring the axial force F between casing hanger 22 and wellhead housing 14. A lower end of lock ring 24 rests on a shoulder S formed on an outer surface of casing hanger 22. The load path between hanger 22 and wellhead housing 14 thus passes through the interface of lock ring 24 and shoulder S. Above shoulder S a fastener 27 projects radially inward and into a threaded bore 28 formed in casing hanger 22. Fastener 27 retains lock ring 24 to casing hanger 22. Below fastener 27 and formed obliquely through casing hanger 22 is a passage 29, which is in communication with slots 20. Thus, communication between passage 29 and slots 20 can define part of a cement return flow path during cementing operations. Optionally, other fluids, such as mud, wellbore fluids, and fracturing fluids, can flow through passage 29 and slots 20.

Figure 3:
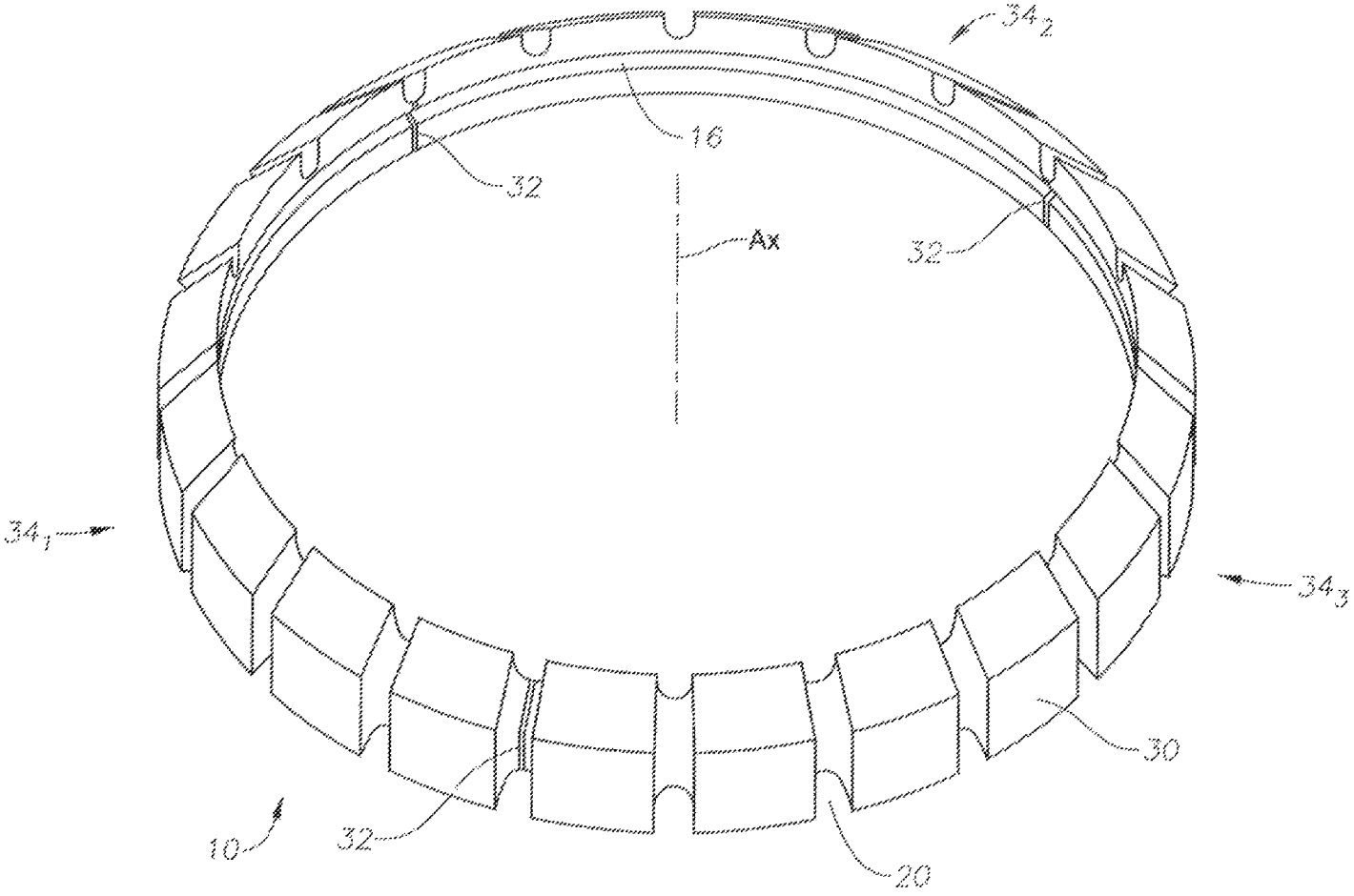
FIG. 3 is a perspective view of an example of the insert of FIG. 1.

FIG. 3 is a perspective view of an example of insert 10, and illustrates how slots 20 extend axially through insert 10 and defines block portions 30 in the insert 10 at circumferentially-spaced locations. Further shown in this embodiment are splits 32 provided at various circumferential locations along insert 10, and which define segments $\mathbf{34}_1$, $\mathbf{34}_2$, $\mathbf{34}_3$. The segments $\mathbf{34}_1$, $\mathbf{34}_2$, $\mathbf{34}_3$ significantly reduce the difficulty of installing insert 10 within wellhead housing 10 (FIG. 1). In an example, splits 32 are disposed at equal angles from one another with respect to axis $A_x$. In the illustrated example the segments $\mathbf{34}_1$, $\mathbf{34}_2$, $\mathbf{34}_3$ extend a full 360° around the circumference of axis $A_x$. In an alternate embodiment, the segments $\mathbf{34}_1$, $\mathbf{34}_2$, $\mathbf{34}_3$ extend less than 360° around the circumference of axis $A_x$.

Figure 4:
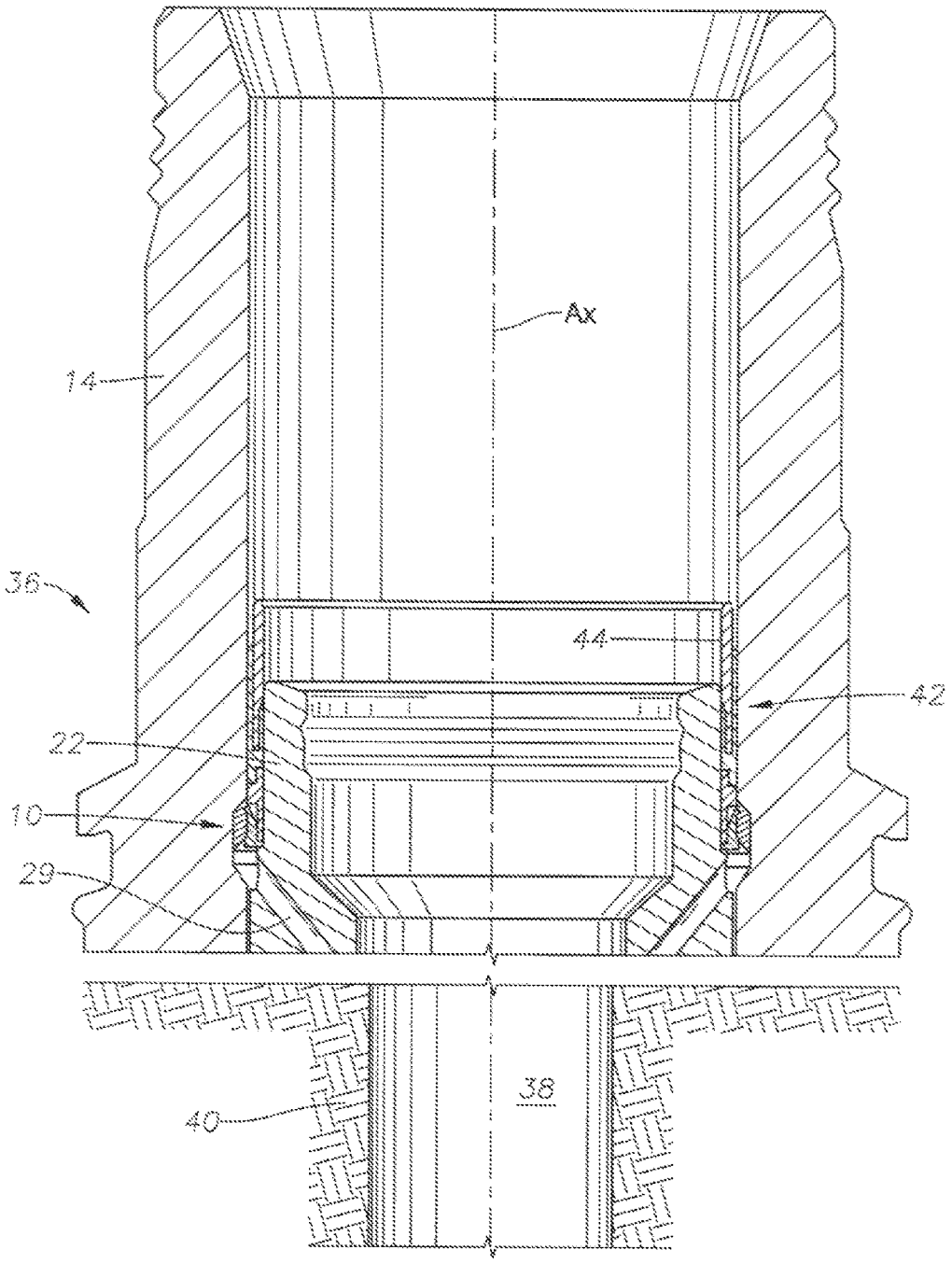
FIG. 4 is a sectional view of the wellhead assembly having an example of an insert and lock ring of FIG. 2.

FIG. 4 shows in a side sectional view one example of the insert 10 included as part of a wellhead assembly 36. In this example, wellhead assembly 36 is mounted over a wellbore 38 shown intersecting a subterranean formation 40. Also shown in FIG. 4 is a seal assembly 42 set in the annular space between casing hanger 22 and wellhead housing 14. In this example, an energizing ring 44 may be used to energize seal assembly 42 and seal the annular space between the casing hanger 22 and wellhead housing 14. An advantage of providing the insert 10 with slots 20 for the bypass or flow return, is that the slots 20 can be machined into the insert 10 more easily than in the wellhead housing 14. Moreover, the higher strength insert 10 can provide for an increased lock down force F without the need to increase the material strength of hanger 22. Thus higher lockdown capacity is not limited by low strength hanger material. Another advantage is that installation cost is reduced because a single trip can accomplish a higher force lockdown. Moreover, higher operating margins are achieved with a lower machining cost (thus less scrap is produced). Another problem solved is that the higher strength insert 10 provides a higher lockdown capacity, even in situations where the material yield strength of the hanger 22 has in the past resulted in a lower lockdown capacity.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellhead assembly comprising:

an annular wellhead housing;

a groove circumscribing an inner circumference of the wellhead housing;

a casing hanger inserted into the wellhead housing set adjacent the groove, the casing hanger having a passage that defines a flow path through the casing hanger; and an insert set in the groove having a slot that defines an axial flow path between the wellhead housing and the casing hanger, wherein the slot is formed within a body of the insert and projects axially through the body of the insert, the slot in fluid communication with the passage of the casing hanger, wherein the insert is pre-installed in the wellhead housing before running any components into the wellhead housing, the insert defining a locking channel circumscribing the inner surface of the insert.

2. The wellhead assembly of claim 1, further comprising a lock ring for transferring an axial force between the casing hanger and the wellhead housing, wherein the lock ring has an upper portion that inserts into the locking channel.

3. The wellhead assembly of claim 2, wherein the inner surface of the insert is generally parallel with an axis of the wellhead assembly above and below the locking channel.

4. The wellhead assembly of claim 1, further comprising a plurality of slots formed in the insert that define a series of block portions in the insert that are between adjacent slots.

5. The wellhead assembly of claim 1, wherein the insert has an upper surface that depends axially downward with a radial distance away from an axis of the wellhead assembly.

6. The wellhead assembly of claim 1, wherein the slot intersects an outer radial surface of the insert.

7. The wellhead assembly of claim 1, wherein the casing hanger passage comprises a cement return passage that is in communication with the slot.

8. The wellhead assembly of claim 1, wherein the insert is formed from a material having a strength that is greater than that of a material of the wellhead housing.

9. The wellhead assembly of claim 1, further comprising a seal assembly between the casing hanger and the wellhead housing above the insert.

10. A wellhead assembly comprising:

a wellhead housing circumscribing an annular hanger, the annular hanger having a passage that defines a flow path through the annular hanger;

an insert extending circumferentially in an annulus between the wellhead housing and hanger, wherein the insert is pre-installed in the wellhead housing before running any components into the wellhead housing, the insert defining a locking channel circumscribing the inner surface of the insert;

a lock ring between the insert and the hanger and which transfers an axial force between the casing hanger and insert, the lock ring having an upper portion that inserts into the locking channel of the insert; and slots in the insert that define a flow path axially through the insert, wherein each of the slots are formed within a body of the insert and respectively projects axially through the body of the insert, the slot in fluid communication with the passage of the annular hanger.

11. The wellhead assembly of claim 10, wherein the hanger comprises one of a casing hanger and a tubing hanger.

12. The wellhead assembly of claim 10, wherein the slots are in communication with an annular space above the insert and that is between the hanger and the wellhead assembly.

13. The wellhead assembly of claim 10, wherein the slots are in communication with an annular space below the insert and that is between the hanger and the wellhead assembly.

14. The wellhead assembly of claim 10, further comprising a seal assembly in an annular space between the hanger and the wellhead housing that is energized with an energizing ring.

15. A wellhead assembly comprising:

an annular wellhead housing;

a groove circumscribing an inner circumference of the wellhead housing;

a casing hanger inserted into the wellhead housing set adjacent the groove, the casing hanger having a passage that defines a flow path through the casing hanger;

an insert set in the groove having a slot that defines an axial flow path between the wellhead housing and the casing hanger, wherein the slot is formed within a body of the insert and projects axially through the body of the insert, the slot in fluid communication with the passage of the casing hanger, and wherein the insert is pre-installed in the wellhead housing before running any components into the wellhead housing, the insert defining a locking channel circumscribing the inner surface of the insert; and a lock ring coupled between the insert and the casing hanger and which forms a load path that extends between the casing hanger and wellhead housing, and through the lock ring and insert.

16. The wellhead assembly of claim 15, wherein the slot extends axially through the insert and intersects a lower surface of the insert, a radial outward surface of the insert, and a radial forward surface of the insert.

17. The wellhead assembly of claim 15, wherein the lock ring further comprises an upper portion that inserts into the locking channel of the insert.

* * * * *